US008984788B2

(12) United States Patent
O'Clair et al.

(10) Patent No.: US 8,984,788 B2
(45) Date of Patent: Mar. 24, 2015

(54) UNITARY SEAR HOUSING BLOCK

(71) Applicant: Smith & Wesson Corp., Springfield, MA (US)

(72) Inventors: Sean O'Clair, Feeding Hills, MA (US); Gary Zukowski, Ludlow, MA (US); Brett Curry, Monson, MA (US)

(73) Assignee: Smith & Wesson Corp., Springfield, MA (US)

( * ) Notice: Subject to any disclaimer, the term of this patent is extended or adjusted under 35 U.S.C. 154(b) by 0 days.

(21) Appl. No.: 14/246,259

(22) Filed: Apr. 7, 2014

(65) Prior Publication Data

US 2014/0317981 A1 Oct. 30, 2014

Related U.S. Application Data

(62) Division of application No. 13/294,531, filed on Nov. 11, 2011, now Pat. No. 8,695,262.

(60) Provisional application No. 61/429,330, filed on Jan. 3, 2011.

(51) Int. Cl.

| | |
|---|---|
| ***F41C 23/00*** | (2006.01) |
| ***F41A 3/12*** | (2006.01) |
| ***F41A 11/02*** | (2006.01) |
| ***F41A 15/12*** | (2006.01) |
| ***F41A 15/16*** | (2006.01) |
| ***F41A 19/12*** | (2006.01) |

(52) U.S. Cl.

CPC . *F41A 3/12* (2013.01); *F41A 11/02* (2013.01); *F41A 15/12* (2013.01); *F41A 15/16* (2013.01); *F41A 19/12* (2013.01)

USPC ..... 42/71.02; 42/41; 42/42.03

(58) Field of Classification Search

CPC ..... F41A 19/21; F41A 19/10; F41A 19/15; F41A 3/66; F41A 19/11

USPC ..... 42/111–148, 71.02, 41–42.03

See application file for complete search history.

(56) References Cited

U.S. PATENT DOCUMENTS

| | | | | | |
|---|---|---|---|---|---|
| 1,350,619 | A | * | 8/1920 | Payne | 42/18 |
| 2,139,203 | A | * | 12/1938 | Gabriel | 89/132 |
| 2,943,412 | A | * | 7/1960 | McNally | 42/69.03 |
| 3,069,976 | A | * | 12/1962 | Stevens, Jr | 89/147 |
| 3,571,961 | A | * | 3/1971 | Lehtinen | 42/69.01 |
| 3,707,796 | A | * | 1/1973 | Bielfeldt | 42/70.05 |
| 3,766,677 | A | * | 10/1973 | Waddell | 42/75.04 |
| 3,808,724 | A | * | 5/1974 | Linde | 42/42.01 |
| 4,409,882 | A | * | 10/1983 | Blackshaw et al. | 89/163 |
| 5,099,595 | A | * | 3/1992 | Chesnut et al. | 42/50 |
| 5,669,169 | A | * | 9/1997 | Schmitter et al. | 42/75.01 |
| 5,717,156 | A | * | 2/1998 | Lenkarski | 89/196 |

(Continued)

*Primary Examiner* — Samir Abdosh

(74) *Attorney, Agent, or Firm* — Ballard Spahr LLP

(57) ABSTRACT

A firearm includes a frame having at least one interior receptacle defined by opposed interior walls and having opposed guide rails extending from the opposed interior walls, and at least one modular housing disposed in the receptacle and accommodating at least one operational component of the firearm. The modular housing is defined by opposed sidewalls having opposed guide channels formed therein, the guide channels being configured to selectively engage the guide rails to facilitate the aligning of the modular housing with respect to the interior receptacle. The at least one operational component and the modular housing are pre-assembled together as an integrated unit for drop-in insertion into the receptacle during assembly of the firearm.

8 Claims, 4 Drawing Sheets

(56) References Cited

U.S. PATENT DOCUMENTS

| | | | | |
|---|---|---|---|---|
| 6,234,059 | B1 * | 5/2001 | Fuchs et al. | 89/196 |
| 6,257,116 | B1 * | 7/2001 | Moczijdlower et al. | 89/155 |
| 6,263,607 | B1 * | 7/2001 | Fuchs et al. | 42/75.01 |
| 6,266,909 | B1 * | 7/2001 | Fuchs et al. | 42/75.01 |
| 6,993,864 | B1 * | 2/2006 | O'Clair et al. | 42/75.02 |
| 7,103,998 | B2 * | 9/2006 | McGarry | 42/16 |
| 7,293,385 | B2 * | 11/2007 | McCormick | 42/75.03 |
| 2006/0156607 | A1 * | 7/2006 | Curry et al. | 42/69.01 |
| 2006/0249014 | A1 * | 11/2006 | Curry | 89/196 |
| 2012/0096752 | A1 * | 4/2012 | Lee | 42/69.01 |

* cited by examiner

UNITARY SEAR HOUSING BLOCK

CROSS REFERENCE TO RELATED APPLICATION

This application is a divisional of U.S. patent application Ser. No. 13/294,531, filed Nov. 11, 2011, which is based upon and claims the benefit of priority to U.S. Provisional Patent Application No. 61/429,330, filed Jan. 3, 2011, both applications being hereby incorporated by reference in their entirety.

FIELD OF THE INVENTION

The present invention relates to firearms and, more particularly, to firearm frames and frame components.

BACKGROUND

Most semiautomatic handguns include a frame and a slide that moves along the firearm's longitudinal firing axis in a reciprocating manner. The frame provides the core support structure for the firearm's operational and other components, e.g., trigger and firing mechanisms, grip, ammunition feeding system, barrel, and slide. For operably attaching the slide to the frame, the frame includes a set of rails positioned on opposite longitudinal sides of the frame. The rails are integral with the rest of the frame, i.e., the frame, including the rails, is machined or otherwise formed from a single piece of metal or other material.

In addition to the rails, the frame includes other integrally machined features for attaching, supporting, and/or guiding additional components of the firearm such as the trigger and firing mechanism sear. While such features (including the rails) function well from an operational standpoint, the manufacturing process for forming the rails and other integral features can be time consuming and complex.

In conventional assembly practices, close measurement and adjustment of sear-to-striker height and longitudinal positioning (typically either by replacement or by remachining of parts) may be required due to variations of several assembly and manufacturing parameters within achievable tolerances. In particular, sear-to-striker height may be affected by the following parameters: the location of the striker with reference to the slide rails, the mating fit of the slide rails with respect to the slide locating rails, the location of the sear housing block relative to the slide locating rails, the sear pivot location within the sear housing block, and the height of the sear itself. Relative longitudinal positioning of the sear and striker within the frame may be affected by several of the above-mentioned parameters, as well as by the longitudinal position of the sear housing block within the frame.

Consequently, it has been conventional to fully assemble an auto-loading pistol and to then check sear-to-striker height, longitudinal positioning, and operation of the firing mechanism within the fully assembled pistol. Measurement of sear-to-striker height within an assembled pistol, and the occasional requirement to remove and replace or re-machine one or more assembled components in order to meet operational tolerances, however, lead to additional labor and expense in manufacturing of autoloading pistols.

Accordingly, it has long been appreciated that it would be advantageous to better control sear-to-striker height and relative longitudinal positioning during assembly of auto-loading pistols.

SUMMARY

In embodiments of the present invention, a firearm includes a firearm frame and a unitary sear housing block. The frame has at least one receptacle formed therein, with the unitary sear housing block being removably received in the receptacle. For example, the receptacle may be an upwardly open compartment integral with the frame and accessible from the top of the frame, and the unitary sear housing block may be configured for "drop-in" insertion into the compartment. The unitary sear housing block is configured for accommodating one or more operational components of the firearm, e.g., triggers, trigger bar, sear assemblies, or the like. That is, one or more firearm components may be operably attached to and I or housed in the unitary sear housing block. In assembling the firearm, the operational components are attached to the unitary sear housing block, the unitary sear housing block is dropped into the receptacle, and the unitary sear housing block is secured in place.

In another embodiment, the unitary sear housing block is provided with a set of slide rails. The slide rails partially or wholly replace the slide rails typically integrally formed on a firearm frame. A slide portion of the firearm moves along the slides in a reciprocating manner during operation of the firearm.

In embodiments of the present invention, a unitary sear housing block assembly for an auto loading pistol includes a sear positioning housing, a sear pivot hole, frame locating grooves and slide locating rails formed with reference to the sear pivot hole, and a frame pin hole formed with reference to the frame locating grooves and the slide locating rails.

In embodiments of the present invention, the frame locating grooves are shaped and positioned to matingly contact complementary rails formed in an autoloading pistol frame while the frame pin hole is aligned to corresponding holes formed through the pistol frame. The frame locating grooves thereby aid in positioning the unitary sear housing block assembly within the pistol frame.

In embodiments of the present invention, the slide locating rails are shaped and positioned to align with corresponding slide locating rails or tabs formed on the pistol frame while the frame pin hole is aligned to corresponding holes formed through the pistol frame and the frame locating grooves are mated to the complementary surfaces of the pistol frame.

Advantageously, by incorporating the frame locating grooves and slide locating rails into the sear housing block, the unitary sear housing block assembly eliminates assembly dimensional variances between the sear housing block and the slide rails, thus reducing as-assembled variances in sear-to-striker height.

Additionally, a firearm including a unitary sear housing block may utilize a "generic" frame provided without integral rails or other features for supporting the sear and slide. Instead, the rails are provided as part of the unitary sear housing block configured to support the firing mechanism. During assembly, the unitary sear housing block may be simply inserted into the frame, at an appropriate pre-configured receptacle, and secured in place.

Additionally, the unitary sear housing block also incorporates the ejector into the sear housing block, thus lowering the total part components making for a more consistent part assembly while lowering the overall cost of the part.

These and other objects, features and advantages of the present invention will become apparent in light of the detailed description of the best mode embodiment thereof, as illustrated in the accompanying drawings.

DETAILED DESCRIPTION OF THE PREFERRED EMBODIMENT

Figure 1:
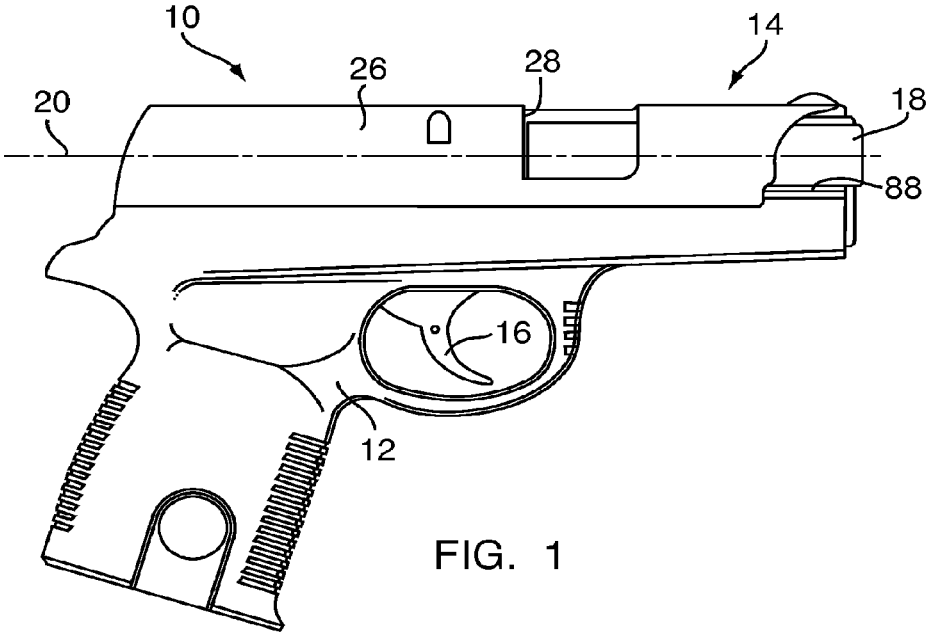
FIG. 1 is a simplified schematic side view of a semiautomatic pistol.
Figure 2:
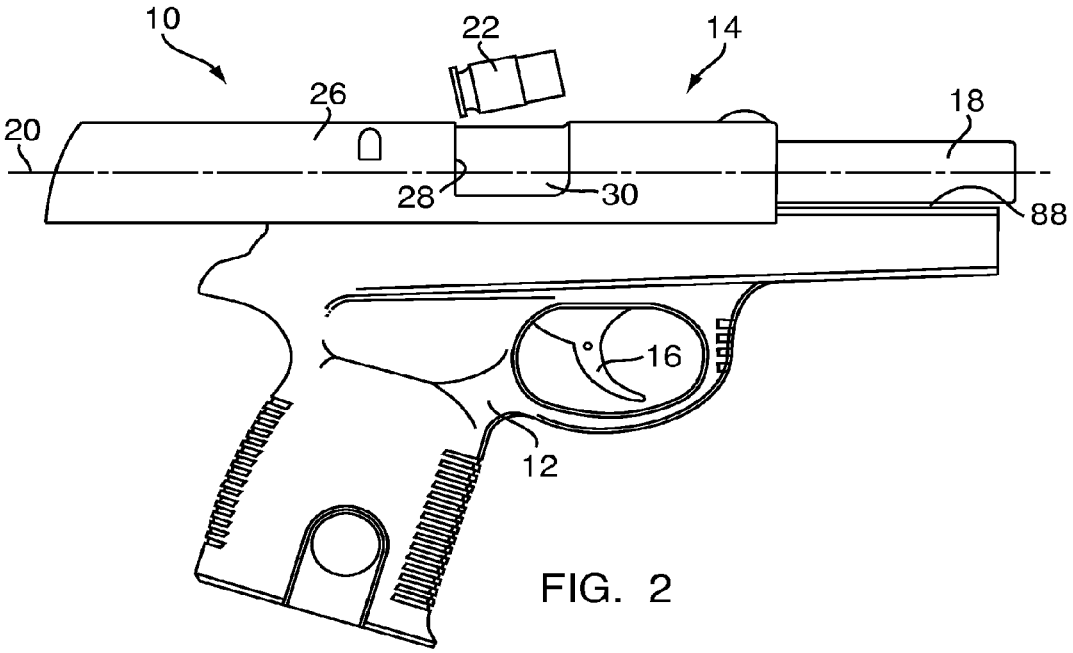
FIG. 2 is a simplified schematic side elevation view of the pistol of FIG. 1 shown with the slide moved to a rearward position on the pistol frame.

Referring to FIGS. 1 and 2, one exemplary embodiment of a semiautomatic pistol or firearm with a unitary sear housing block of the present invention is shown generally at 10 and is hereinafter referred to as "firearm 10." The firearm 10 comprises a frame 12, a slide 14, and a fire control mechanism that operates via actuation of a trigger 16. The frame 12 is fabricated of a high-impact polymer material, metal, or a combination of polymer and metal. The slide 14 houses a barrel 18 in the forward end thereof. The barrel 18 is cooperatively linked with the slide 14 and, together with the slide 14, defines a longitudinal firing axis 20. A rearward end of the barrel 18 is adapted for receiving an ammunition cartridge 22.

The slide 14, which is defined by a slide frame 26, further includes a breech face 28 and an ejection port 30. The breech face 28 is engagable with the rearward end of barrel 18 to form a firing chamber when the slide 14 is disposed forwardly on the frame 12 (FIG. 1). An ejection mechanism included in the slide 14 provides for the ejection of a cartridge casing 22 upon firing the firearm 10 or manually cycling the slide 14.

Figure 3:
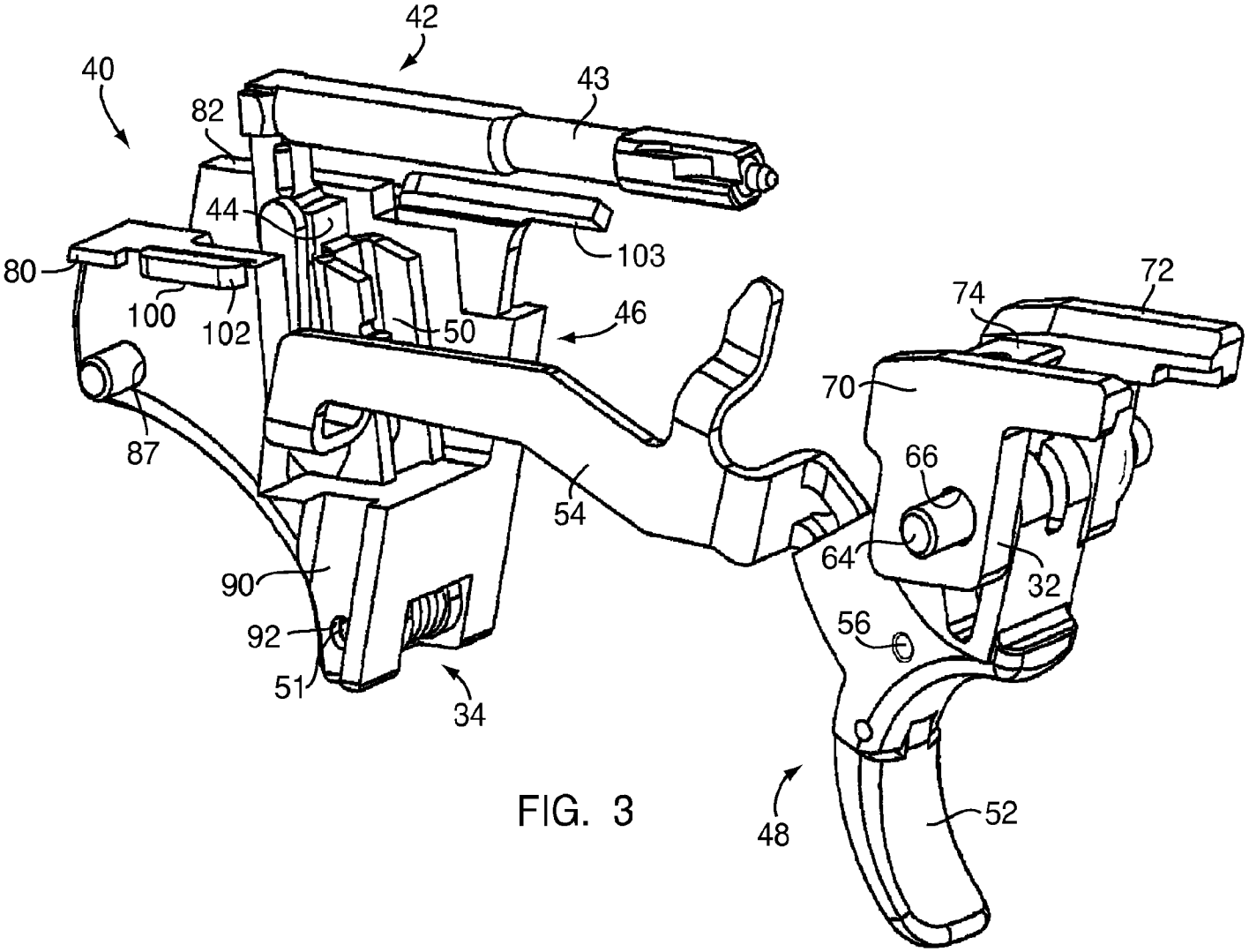
FIG. 3 is a simplified schematic perspective view of a firing mechanism and unitary sear housing block of a semiautomatic pistol according to an embodiment of the present invention.

Referring now to FIG. 3, the firearm further comprises a trigger mechanism housing 32 and a unitary sear housing block 34. The trigger mechanism housing 32 and unitary sear housing block 34 together support portions of a fire control mechanism generally shown at 40. In the exemplary embodiment of FIGS. 1-6, for purposes of illustration, the fire control mechanism 40 is of a striker-type configuration and comprises a striker-type striker 42 having a striker portion 43 and a depending leg 44. However, the present invention can be adapted for use with different types of firing mechanisms, and is not meant to be limited to a particular type of firing mechanism.

Still referring to FIG. 3, the exemplary fire control mechanism 40 further includes a sear assembly 46 and a trigger assembly 48. The sear assembly 46 has a sear 50 pivotally mounted onto a sear pin 51, such that an upper end of the sear 50 may engage the striker 42. The trigger assembly 48, which functions to actuate the sear 50, includes a trigger 52 pivotally connected to the trigger mechanism housing 32, and a trigger bar 54 pivotally connected to the trigger 52 via a pin 56. The trigger bar 54 connects the trigger 52 and the sear assembly 46. The trigger 52 may be of a multiplepiece articulated construction, as shown, or of unitary construction.

When the trigger 52 is actuated by being pressed in a rearward direction, the trigger 52 pivots about a pin 64 that extends through a lateral opening 66 in the trigger mechanism housing 32. This transmits movement to the trigger bar 54 via the pin 56. The trigger bar 54 is thereby moved in a rearward direction for actuation of the sear 50. When actuated, the sear 50 pivots rearwardly about the sear pin 51, thereby releasing its engagement with the striker 42.

The trigger mechanism housing 32 is a generally open frame-like support having first and second sidewalls 70, 72 interconnected by one or more lateral cross members 74. The sidewalls 70, 72 are provided with various laterally aligning openings, e.g., the lateral opening 66, for attachment of various subcomponents and/or for attachment of the trigger mechanism housing 32 to the frame 12. As noted, the interior of the trigger mechanism housing 32 is generally open, to accommodate the trigger 52 as well as any other components configured for disposition between the two sidewalls 70, 72.

Figure 4:
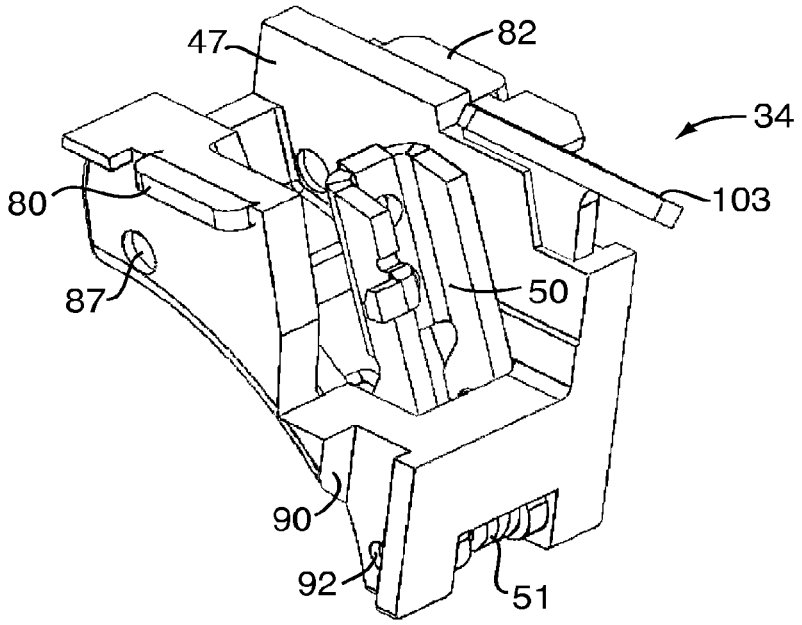
FIGS. 4 and 5 are detail perspective views of the unitary sear housing block shown in FIG. 3.
Figure 5:
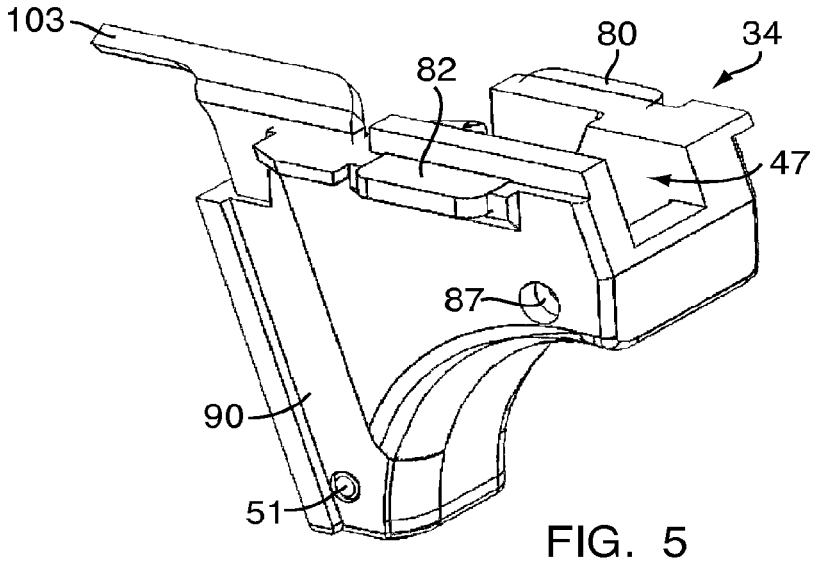

The unitary sear housing block 34 is a generally solid body having a number of openings, slots, etc. formed therein for accommodating the various components of the sear assembly 46. Detailed views of the unitary sear housing block 34 are shown in FIGS. 3-5. The particular number of openings and slots in the unitary sear housing block 34, and their dimensions I configurations, will depend on the particular nature and configuration of the sear assembly components, which, of course, will depend on the type of sear assembly utilized. For example, as shown in FIGS. 4 and 5, the unitary sear housing block 34 may have a longitudinal slot 47 formed therein for accommodating the sear 50, as well as, the passage of the depending leg 44 of the striker 42 and of the trigger bar 54.

For reciprocal movement of the slide 14 along the frame 12, the sear housing block 34 has a pair of rear slide rails 80, 82 attached to, and extending laterally outwards from, opposite upper side edges of the unitary sear housing block 34. The slide rails 80, 82 are substantially identical in shape, and are dimensioned to fit within opposed, inwardly opening and longitudinally extending grooves (not shown) located on the inner surface of the slide 14. The slide rails may have arcuate, convex bottom surfaces 100 and/or chamfered or rounded leading and trailing edges 102 to prevent the slide 14, upon discharge of the firearm 10, from the possibility of binding or overstressing the housings 32, 34. An ejector bar 103 is formed integrally with the sear housing block 34 for cooperation with the ejection mechanism formed in the slide 14.

The unitary sear housing block 34 may be manufactured using standard methods, such as machining or molding, in which case the slide rails are integrally formed as part of the housing 34. Alternatively, the housing 34 may be assembled from various subcomponents attached together using standard means such as welding, adhesives, or fasteners. The housing 34 may be made of various materials, but will typically be composed of a light, high-strength metal or metal alloy.

It is envisioned that the sear housing block may be manufactured by over molding a detailed stamping with polymer.

Figure 6:
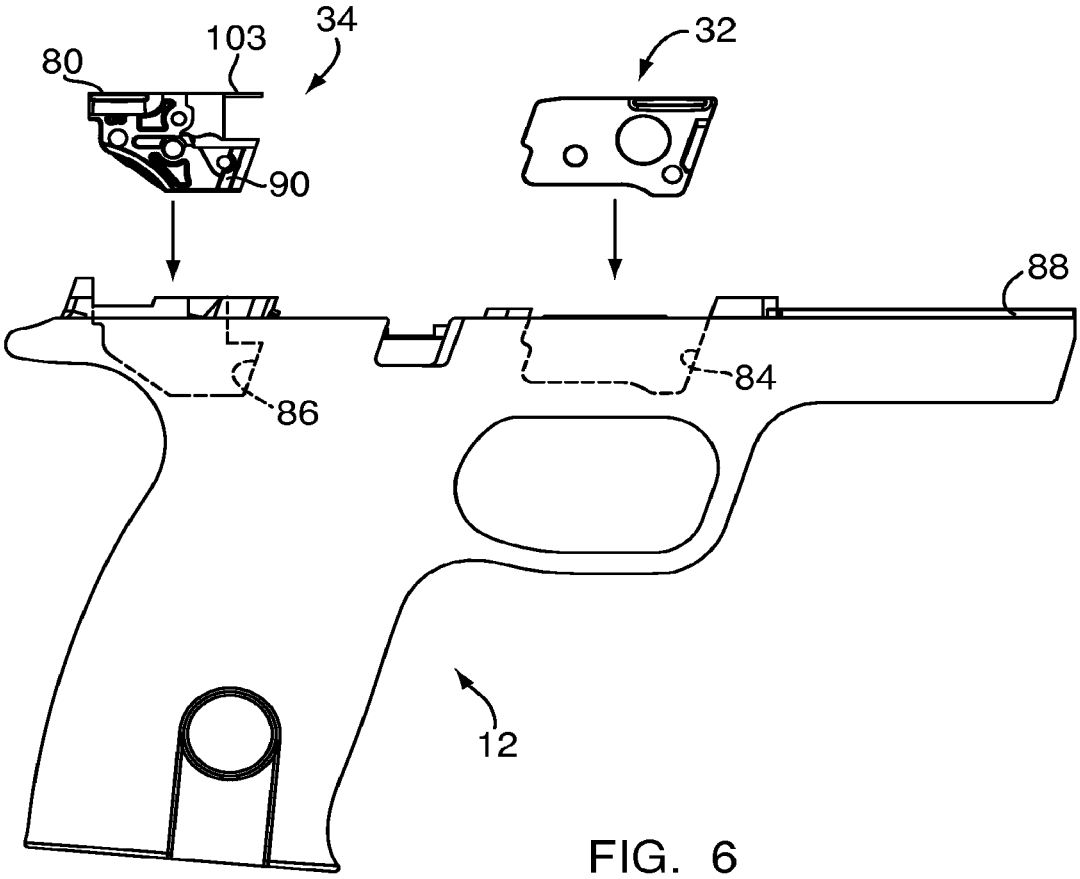
FIG. 6 is a simplified schematic view of the semiautomatic pistol of the present invention.

FIG. 6 schematically illustrates the manner in which the sear housing block 34 and trigger mechanism housing 32 are attached to the frame 12. As indicated, unitary sear housing block 34 and trigger mechanism housing 32 are configured for "drop in" insertion into the frame 12. The frame includes a forward receptacle 84 and a rear receptacle 86. The forward receptacle 84 is dimensioned to securely receive the trigger mechanism housing 32 and the rear receptacle 86 is dimensioned to securely receive the sear housing block 34.

The receptacles 84, 86 are interior, upwardly open compartments or receptacles integrally formed as part of the frame 12 during manufacturing, and are complementary in shape to trigger mechanism housing 32 and the housing 34, respectively. Once inserted into the receptacle 86, the housing 34 is attached to the frame 12 using adhesives, welds, press or friction fit, or pins or the like (not shown). Optimally, the unitary sear housing block 34 is pinned into the frame 12 by a frame pin inserted through a frame locating hole 87.

Additionally, the receptacle 86 is provided with angled or vertically oriented rails (not shown) for engagement into grooves or channels 90 formed in the sides of the unitary sear housing block 34 (see FIGS. 3-5), for purposes of easily aligning the unitary sear housing block 34 with respect to the receptacle and frame for assembly. Notably, the frame locating hole 87 and the locating grooves 90 cooperate to accurately position the rear slide rails 80, 82. Likewise, a hole 92, for receiving the sear pin 51, is formed in the body portion of the sear housing block 34 to ensure accurate and precise positioning of a pivotable sear with respect to the firing mechanism and with reference to the frame 12. As the rear slide rails 80, 82 also position the striker 42 with reference to the frame 12, the frame locating hole 87 and the locating grooves 90 work in tandem with the hole 92 and pin 51 to provide for accurate assembly of a functional firing mechanism at reduced cost when compared to prior modes of locating a sear within a firearm frame. Importantly, the frame locating hole 87, slide rails 80, 82, locating grooves 90 and sear position hole 92 ensure proper alignment of the sear mechanism with respect to the firing mechanism (striker), i.e., sear to striker height.

Once inserted into and attached to the frame 12, the rear slider rails 80, 82 of the unitary sear housing block 34 lie in operative alignment with lead rails 88 (see FIGS. 1-2) on either side of the fore/barrel end of the frame 12, for further guidance of the slide 14. In particular, the rails 80, 82, 88 extend along the underside of the slide 14 in the longitudinal direction to allow for cycling of the slide 14 between forward (battery) and rearward (retired) positions. Also, the trigger bar 54 is connected to the sear assembly 46. Importantly, by incorporating the rails 80, 82 into the sear housing block 34, any assembly variances between the sear housing block and the slide rails is eliminated, thus lowering any seen manufacturing and assembly differences.

In addition, as will be readily appreciated, by incorporating the ejector 103 into the sear housing block 34 as discussed above, total part components for the entire firearm is lowered, this making for a more consistent part assembly while lowering the overall cost of the firearm as a whole.

With the sear housing block 34 provided as a separate, modular component for attachment to the frame 12, it is no longer necessary to machine or otherwise form the various component features of the housing 34 as part of the frame 12 during the manufacturing process. Accordingly, the overall design and manufacturing process is rendered more efficient, more flexible (e.g., the possibility of different configurations and I or different materials for the frame 12 and housing 34), and with less potential waste from manufacturing errors. Additionally, because the trigger and sear mechanism subcomponents can be attached to the housings prior to attaching the housings to the frame, the assembly process is simplified.

As should be appreciated, the receptacle 86 and unitary sear housing block 34 may be characterized as "modular housing means" cooperative with the frame 12 for removably supporting one or more operational components of the firearm (e.g., the housings support the operational components and can be inserted into and removed from the receptacles) and for supporting the slide 14 in a reciprocating manner.

An additional embodiment of the present invention may be characterized as a modular firearm system having one or more firearm frames 12 and one or more separate housing 34, for holding, supporting, and/or guiding portions of a firearm operational mechanism. Each frame 12 has one or more receptacles for receiving the housings. The frames and housings are interchangeable, meaning that each frame accommodates all or some of the housings. Some of the receptacles may be configured to only accept one subset of the housings, e.g., if the frame has two receptacles, the first receptacle may be configured to accept one subgroup of housings and the second receptacle another subgroup of housings.

Although this invention has been shown and described with respect to the detailed embodiments thereof, it will be understood by those of skill in the art that various changes may be made and equivalents may be substituted for elements thereof without departing from the scope of the invention. In addition, modifications may be made to adapt a particular situation or material to the teachings of the invention without departing from the essential scope thereof. Therefore, it is intended that the invention not be limited to the particular embodiments disclosed in the above detailed description, but that the invention will include all embodiments falling within the scope of the above description.

What is claimed is:

1. A firearm comprising:

a frame having at least one interior receptacle defined by opposed interior walls, said interior receptacle having opposed guide rails extending from said opposed interior walls;

a slide mounted on said frame and reciprocably movable relatively thereto;

at least one modular housing disposed in said at least one receptacle and accommodating at least one operational component of said firearm, said at least one modular component comprising a unitary sear housing block accommodating at least one sear mechanism component of said firearm, said modular housing being defined by opposed first and second generally parallel and spaced apart sidewalls, said at least one sear mechanism component of said firearm being located between said first and second sidewalls, said unitary sear housing block including a sear positioning hole configured to receive a pin for pivotally retaining said sear mechanism within said unitary sear housing block between said first and second sidewalls, said sear positioning hole being located so as to properly align a height of said sear mechanism to a striker mechanism of said firearm, said sidewalls being interconnected by at least one lateral cross member and having opposed guide channels formed in said opposed sidewalls, said guide channels being configured to selectively engage said guide rails to facilitate the aligning of said at least one modular housing with respect to said interior receptacle, said at least one modular housing comprising a body portion and slide rails attached to said body portion, said slide rails being configured for facilitating reciprocating movement of said slide, wherein a first one of said slide rails is attached to said first sidewall and a second one of said slide rails is attached to said second sidewall and wherein said body portion and said slide rails are integrally formed together;

wherein said at least one operational component and said modular housing are pre-assembled together as an integrated unit for drop-in insertion into said receptacle during assembly of said firearm.

2. The firearm of claim 1, wherein:

said guide rails and said guide channels are oriented substantially vertically.

3. The firearm of claim 1, wherein:

said modular housing includes an ejector bar unitarily formed with modular housing.

4. The firearm of claim 1, wherein:

said at least one modular housing includes at least one frame locating aperture formed in at least one of said opposed sidewalls, said fame locating aperture being located so as to be aligned with a complimentary aperture in one of said opposed interior walls of said frame when said modular housing is properly positioned within said receptacle; and wherein said frame locating aperture is configured to receive a pin therein for securing said modular housing to said frame.

5. A firearm comprising:

a frame having at least one interior receptacle defined by opposed interior walls;

a slide mounted on said frame and reciprocably movable relatively thereto;

at least one modular housing disposed in said at least one receptacle and accommodating at least one operational component of said firearm, said at least one modular housing including a body portion, said body portion comprising first and second spaced apart, generally parallel sidewalls interconnected by at least one lateral cross member, said first and second sidewalls defining a longitudinal space therebetween, said space being dimensioned to accommodate a sear mechanism having a pivotal sear, said body portion including a sear positioning hole configured to receive a pin for pivotally retaining said sear mechanism within said longitudinal space between said first and second sidewalls, said sear positioning hole being located so as to properly align a height of said sear mechanism to a striker mechanism of said firearm, slide rails being attached to said body portion, said slide rails being configured for facilitating reciprocating movement of said slide thereon;

wherein said body portion and said slide rails are pre-assembled together as an integrated unit for drop-in insertion into the receptacle during assembly of said firearm.

6. The firearm of claim 5, wherein:

said interior receptacle includes at least one alignment tab protruding from said opposed interior walls; and said body portion includes a slot formed in at least one of said first and second sidewalls, said at least one alignment slot being configured to selectively engage said at least one alignment tab of the frame receptacle.

7. The firearm of claim 5, wherein:

said modular housing includes an ejector unitarily formed with said body portion.

8. The firearm of claim 5, wherein:

said at least one modular housing includes at least one frame locating aperture formed in at least one of said first and second sidewalls, said fame locating aperture being located so as to be aligned with a complimentary aperture in one of said opposed interior walls of said frame when said modular housing is properly positioned within said receptacle; and wherein said frame locating aperture is configured to receive a pin therein for securing said modular housing to said frame.

* * * * *